United States Patent [19]

Jugle

[11] 4,100,611

[45] Jul. 11, 1978

[54] APPARATUS FOR CONTROLLING AIRBORNE PARTICLE EMISSION

[75] Inventor: Don B. Jugle, Penfield, N.Y.

[73] Assignee: Xerox Corporation, Stamford, Conn.

[21] Appl. No.: 685,231

[22] Filed: May 11, 1976

[51] Int. Cl.[2] ..... B01F 13/06

[52] U.S. Cl. ..... 366/139; 366/325

[58] Field of Search ..... 259/1 R, 4 R, 9, 10, 259/2, 109, 110; 15/1.5 R; 118/652; 355/15; 366/139, 348, 349

[56] References Cited

U.S. PATENT DOCUMENTS

| | | | |
|---|---|---|---|
| 3,306,193 | 2/1967 | Rarey | 15/1.5 R |
| 3,696,785 | 10/1972 | Andrus | 118/652 |
| 3,697,050 | 10/1972 | Stanley | 259/4 R |
| 3,920,329 | 11/1975 | Pennie | 15/1.5 R |

*Primary Examiner*—Robert W. Jenkins

[57] ABSTRACT

A system for minimizing free airborne particles generated by movement of a two component powder material within a partially open container. The two component material includes a relatively large component and a relatively small component as is used in carrier and toner for developing electrostatographic images. A filter with predetermined pore size is positioned across the flow of the two component material and connected to a source of negative pressure.

3 Claims, 2 Drawing Figures

APPARATUS FOR CONTROLLING AIRBORNE PARTICLE EMISSION

BACKGROUND OF THE INVENTION

Figure 1:
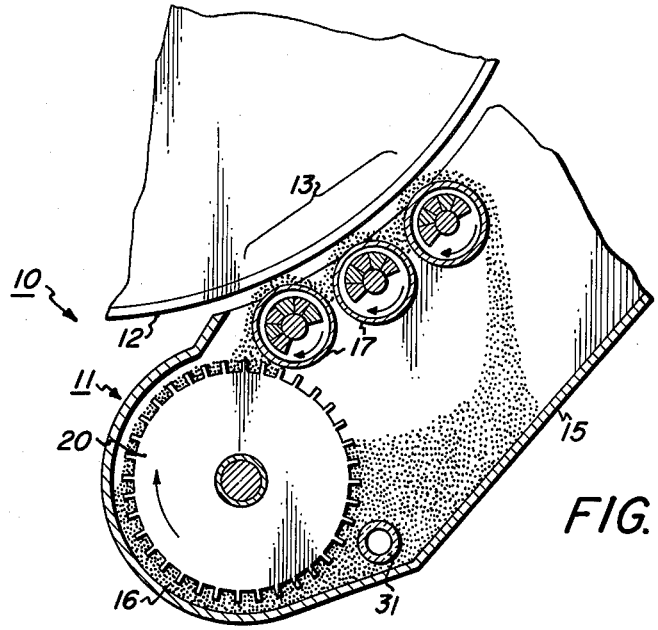

This invention relates to particle emission control techniques for use in the control of airborne particles separated from a two component powder which has been agitated in a partially open container as, for example, the development system of an electrostatographic processor.

In a conventional electrostatographic printing process of the type described in Carlson's U.S. Pat. No. 2,297,691 on "Electrophotography", a uniformly charged imaging surface is selectively discharged in an image configuration, thereby forming a latent electrostatic image. That image is then developed by applying a finely divided, electroscopic coloring material, called "toner", to the imaging surface.

Sometimes the process is carried out in a "non-transfer mode", meaning that the imaging surface serves as the ultimate substrate for the toned or developed image. Favored, however, is a "transfer mode" in which the developed image is transferred to a separate substrate, such as plain paper, so that the imaging surface may be reused after any residual toner has been removed therefrom. Indeed electrostatographic printing has enjoyed outstanding commercial success, especially in plain paper xerographic copiers and duplicators.

One of the common characteristics of the electrostatographic printing process is the development step. Modern processors generally carry out that step on the fly — viz. as the imaging surface moves through a development zone. To accomplish that, they normally include a cascade or a magnetic brush development system for circulating a two component developer material along a path running from a sump, through the development zone, and then back to the sump.

Briefly, the developer used in such a development system is basically a dry mixture of toner particles with or without fine additives and larger, so-called "carrier" particles as described, for example, in U.S. Pat. Nos. 3,590,000, 3,819,367 and 3,900,588. In practice, the materials for the toner and carrier (or sometimes, carrier coating) components of the mixture are selected from different positions in the triboelectric series so that electrical charges of opposite polarities tend to be imparted to the toner and carrier particles when the developer components are blended together. Moreover, in making those selections, consideration is given to the relative triboelectric ranking of the materials to the end that the polarity of the normal charge for the toner particles opposes the polarity of the latent images which are to be developed. Consequently, in operation, there are competing electrostatic forces acting on the toner particles. Specifically, one set of forces tend to attract them to the carrier particles while another set of forces tends to electrostatically strip them from that portion of the developer which is brought into the immediate proximity of or actuate contact with the image bearing surface.

An electrostatographic processor configured to operate in the transfer mode additionally includes a cleaning system for removing residual toner from the imaging surface after the developed image has been transferred to, say, plain paper. Again, modern processors usually carry out the step on the fly — viz, as the imaging surface moves through a cleaning zone. For that reason, such processors typically include a cleaning blade, brush or web for mechanically removing any residual toner which may tend to adhere to the imaging surface despite the transfer step.

Experience with toner handling subsystems of the aforementioned type has deomonstrated that such systems often are sources of uncontrolled and undesired emissions of toner. It is known that the principal cause of that problem is the free toner which is captured in a suspended state and blown about by the air currents to which those systems are subjected. Prior attempts in solving this problem by a controlled air flow as described for example in U.S. Pat. Nos. 3,685,485 and 3,909,864 have not been entirely successful due to the poor prefiltration through baffles and the necessity to change filters frequently. The instant invention utilizes an improved toner emissioner control system and is specifically an improvement over copending application Ser. No. 597,129 filed on July 18, 1975, now abandoned, and commonly assigned herewith.

Accordingly, a primary object of the present invention is to provide an improved system for suppressing undesired emissions of airborne particles from agitated two component powders in a partially open container.

Another object of the invention is to provide a simple and reliable toner emission control technique for recombining airborne toner particles with a two component developer material composed of toner and carrier particles.

Still another object of the invention is to ensure continuous prefiltering of moving airborne particles by flowing powder with which the airborne particles are recombined.

Figure 2:
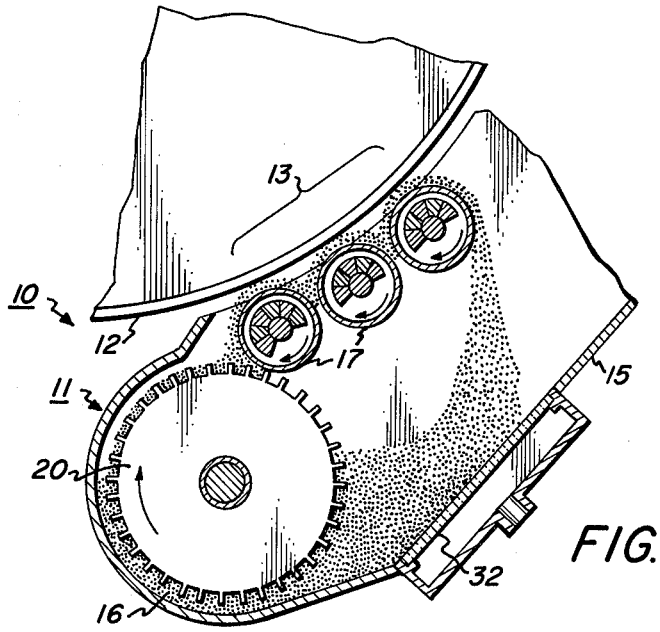

Still further objects and advantages of this invention will become apparent when the following detailed description is read in conjunction with the attached drawings in which:

FIG. 1 is a simplified sectional view of a typical development apparatus having a toner emission control system in accordance with the present invention; and FIG. 2 is view similar to FIG. 1 of an alternative embodiment.

While the invention is described in some detail hereinbelow with specific reference to certain illustrated embodiments, it is to be understood that there is no intent to limit it to those embodiments. For example, although the above describes the use of the invention in an electrostatographic processor, it is easily seen that invention is applicable to such diverse fields of endeavor as the storage and transport of grain in grain elevators and the transport of coal in chutes. In fact the invention is applicable whenever there is a possibility of a two component system consisting of large particles and small dust-like particles. The aim is to cover all modifications, alternatives, and equivalents falling within the spirit and scope of the invention as defined by the appended claims.

Turning now to FIG. 1 it will be seen that there is shown an electrostatographic processor 10 (shown only in relevant part) having a magnetic brush development apparatus 11 for developing latent electrostatic images carried by an imaging surface 12 on the fly — viz., as the imaging surface 12 moves through a development zone 13. In this instance, the processor 10 is a generally conventional drum-type xerographic unit having a photoconductive imaging surface coated on a rotatably driven drum. Of course, that is just one example of a suitable processor configuration.

In keeping with standard practices, the development apparatus 11 has a housing 15 which contains a sump 16 for storing a supply of developer (i.e., a dry mixture of toner particles and ferromagnetic carrier particles). Mounted within the housing 15 there are a plurality of applicator rolls 17 and a paddle wheel 20 for circulating the developer along a path which runs from the sump 16, through the developement zone 13, and then back into the sump 16. To that end, each of the rolls 17 typically comprises a permanent magnet assembly (not shown) which is stationarily supported within a rotatably driven, non-magnetic sleeve.

More particularly, in operation, developer is fed from the sump 16 via paddle wheel 20 which maintains a desired flow. After leaving the sump 16, the developer is magnetically entrained on successive rolls as it advances through the development zone 13 and then back toward the sump 16. Specifically, the applicator rolls which are spaced a predetermined short distance from the imaging surface 12, convey the developer through the development zone 13 under the influence of a magnetic field which is shaped to cause the developer to collect into bristle-like stacks of streamers as it passes through the nips between the imaging surface 12 and the rolls 17. The streamers brush against the image surface 12, thereby providing a ready source of toner for developing any latent images which happen to be present. Thereafter, the used or partially denuded developer is returned to the sump 16.

Some toner is necessarily consumed in the development process. Therefore, a dispenser (not shown) is conventionally made for adding additional toner from time to time, thereby maintaining the toner concentration of the developer at a suitably high level. Paddle wheel 20 serves to maintain a reasonably uniform distribution of the available toner and to promote the triboelectric charging of the toner and carrier particles.

The carrier particles of most developer mixtures have sufficient weight to be substantially insensitive to the air currents which are generated in the ordinary course by the motion of the imaging surface and of other components of the processor, including the moving parts of the development system. Typically the carrier particles have a size ranging from about $50\mu$ to about $500\mu$. Unfortunately, the same cannot be said for the toner particles which have a size from about $2\mu$ to about $40\mu$. Instead, these toner particles are so light that they are easily captured by the ordinary air currents, unless they are mechanically or electrostatically associated with the heavier host, such as the carrier particles. Consequently, free toner particles (i.e., those which are not associated with a suitable host) tend to become airborne when exposed to the air currents and are therefore likely to lead to unwanted toner emissions.

In accordance with this invention, the development apparatus 11 as shown in FIG. 1, is equipped with a toner emission control system which includes a porous tubular filter member 31 positioned in sump 16. An exhaust fan (not shown) or the like is connected to the filter member 31 to maintain a slight negative pressure or vacuum on the housing 15, thereby drawing the airborne toner particles away from the imaging surface 12 and towards the filter member. The negative pressure or vacuum level is selected so that it does not disturb the carrier particles but does ensure that there is no significant flow of air out of the housing 15. Filter member 31 is made from any suitable material. A preferred material is sintered glass or metal. Typically the pores in the filter member have a pore size such that the typical airborne toner particles which are not recombined with the developer material are greater in size than the pores. By this structure the developer material which flows acts as a prefiltering device, reducing the filtration necessary by filter member 31. Moreover, the flowing developer serves to clean and scavenge the toner particles from the filter member.

It has been found that the improved emission control system works well because most of the airborne toner particles are sufficiently large due to a low charge-to-mass ratio yet, they have sufficient charge to be attracted to the carrier when brought in contact with it. Thus, there is both a physical and electrostatic attraction of the small and large particles.

FIG. 2 is another embodiment of the invention wherein filter member 32 is in the form of a plate which is part of the housing.

Above is described a simple but effective system for suppressing unwanted emissions of airborne particles separated from a two component powder which has been agitated in at least a partially open container.

While the invention has been described with reference to the structure disclosed, it is not confined to the details set forth, but is intended to cover such modifications or changes as may come within the scope of the following claims.

What is claimed is:

1. An improved filtering apparatus for suppressing airborne particle emission from a partially open container comprising a partially open container for containing a two component powder including a relatively large component and a relatively small component, means for agitating said two component powder to cause at least a portion of said small component to become airborne particles, means for generating an air flow into said container through the agitated powder to recombine said airborne particles therewith and filter means positioned to receive the air flow and any uncombined airborne particles, said filter means having openings smaller than said uncombined particles and being positioned so as to be continuously cleaned by the flow of the two compound powder thereacross.

2. Apparatus according to claim 1 wherein the relatively large component is at least $50\mu$ in size and the relatively small compinent is less than $40\mu$ in size.

3. Apparatus according to claim 1 wherein said large and small components have an electrostatic attraction.

* * * * *